US006164205A

United States Patent [19]

Metrope

[11] Patent Number: 6,164,205

[45] Date of Patent: Dec. 26, 2000

[54] REMOTELY CONTROLLABLE CLAMPING AND TENSIONING DEVICE ON A PRINTING-UNIT CYLINDER

[75] Inventor: Jacques Metrope, Laigneville, France

[73] Assignee: Heidelberger Druckmaschinen AG, Heidelberg, Germany

[21] Appl. No.: 09/391,716

[22] Filed: Sep. 8, 1999

[30] Foreign Application Priority Data

Sep. 8, 1998 [DE] Germany ..... 198 40 750
Aug. 25, 1999 [FR] France ..... 99 10778

[51] Int. Cl.[7] ..... B41F 27/12

[52] U.S. Cl. ..... 101/415.1; 101/378

[58] Field of Search ..... 101/415.1, 378, 101/409

[56] References Cited

U.S. PATENT DOCUMENTS

| | | | |
|---|---|---|---|
| 3,370,533 | 2/1968 | Westra et al. | 101/269 |
| 4,596,185 | 6/1986 | Shimizu | 101/415.1 |
| 4,938,135 | 7/1990 | Wieland | 101/415.1 |
| 5,142,305 | 8/1992 | Maslanka et al. | 101/415.1 |
| 5,383,401 | 1/1995 | Brotzman | 101/415.1 |
| 5,398,606 | 3/1995 | Becker | 101/415.1 |
| 5,562,036 | 10/1996 | Barrios et al. | 101/415.1 |
| 5,588,363 | 12/1996 | Becker | 101/230 |
| 5,685,226 | 11/1997 | Fuller | 101/415.1 |
| 6,026,746 | 2/2000 | Andaloro | 101/415.1 |

FOREIGN PATENT DOCUMENTS

| | | |
|---|---|---|
| 37 31 684 A1 | 4/1989 | Germany . |
| 41 34 310 A1 | 4/1993 | Germany . |
| 42 31 673 A1 | 3/1994 | Germany . |
| 44 01 684 C2 | 7/1995 | Germany . |
| 44 42 300 A1 | 8/1995 | Germany . |

*Primary Examiner*—John S. Hilten
*Assistant Examiner*—Leslie J. Grohusky
*Attorney, Agent, or Firm*—Herbert L. Lerner; Laurence A. Greenberg; Werner H. Stemer

[57] ABSTRACT

A device for actuating a tensioning device for fastening flexible packings to printing-unit cylinders of rotary printing machines, the actuating device having a tensioning shaft for accommodating respective ends of flexible packings, for clamping at least one end of the flexible packings, and an actuating mechanism arranged outside the printing-unit cylinder for activating the tensioning shaft, includes an actuating element passing through a cylinder journal of the printing-unit cylinder and being displaceable axially relative to the cylinder journal, and a transmission element via which the displacement of the actuating element is convertible into a rotational movement of an attachment to the tensioning shaft; and a printing unit and a printing-unit cylinder having the actuating device, as well as a method of operating a tensioning device for fastening flexible packings.

22 Claims, 4 Drawing Sheets

REMOTELY CONTROLLABLE CLAMPING AND TENSIONING DEVICE ON A PRINTING-UNIT CYLINDER

BACKGROUND OF THE INVENTION

Field of the Invention

The invention relates to a remotely controllable clamping and tensioning or tautening device on a printing-unit cylinder, which may be provided in a printing unit of a rotary printing machine.

The published European Patent Application EP 0 737 574 A2 relates to a tensioning device in a rotary printing machine. In this device for fastening and tensioning a rubber blanket, a printing blanket or a printing plate on a cylinder of a rotary printing machine, the objective is to provide a tensioning or tautening of the printing blanket that is uniform over the entire web width as a result of torsion-free rotation of a tensioning spindle. In this regard, a uniform retensioning should also be able to take place during operation. In accordance therewith, the tensioning spindle is provided with toothing on the circumference thereof, and the toothing meshes with racks which are arranged so as to be movable transversely to the axis of rotation of the tensioning spindle. The racks are arranged so as to be drivable by an actuator counter to a prestressing force of springs.

The published German Patent Application DE 37 22 174 C2 is concerned with a device for clamping a flexible printing plate on the plate cylinder of a sheet-fed rotary printing machine. In this device for clamping a flexible printing plate on the plate cylinder of a sheet-fed rotary printing machine, one end of the printing plate that is formed with a bend can be placed onto the edge of the plate cylinder, and the other end of the printing plate can be pressed against the one end of the printing plate by a tensioning bar. The tensioning bar is mounted so that it is swivellable coaxially with the axis of the plate cylinder, the tensioning bar being firmly seated on bearer rings which are loosely and laterally slid onto the two cylinder journals of the plate cylinder. The bearer rings are swivellable by an hydraulic tensioning device that, in a cavity formed in one of the cylinder journals, has a hydraulic cylinder equipped with an adjustable piston. The hydraulic cylinder is connected via a manifold or distributor system to ancillary cylinders which are arranged endwise in a recess formed in the plate cylinder, and each have an adjusting piston respectively resting in a force-locking manner against a crank pin mounted in the bearer rings eccentrically to the axis of the plate cylinder.

The published European Patent Document EP 0 534 579 B1 is concerned with a plate exchange device on a rotary printing machine. The plate exchange device includes a plate winding rod that is fitted swivellably in a winding-rod hole formed in an outer circumferential part of a plate cylinder and includes a spring groove extending virtually over the entire length of the latter. In addition, the plate exchange device includes a plurality of leaf springs, each formed from a leaf-spring element and having a U-shaped cross section, said leaf springs being provided in the spring groove and each having an end formed with a pressure part to load a leading end of a plate against a surface of a gap in the plate cylinder, and another end, formed with a curved part, to grip a curved end of the plate wound around a circumferential surface of the plate cylinder. In addition, provision is made for a preloaded element to preload the plate winding rod in a predetermined direction of rotation, and also for a plate winding-rod rotating unit, that is coupled by a cam mechanism to an end part of the plate winding rod. Further provided are a plate press roll extending in an axial direction of the plate cylinder and close to the circumferential surface thereof, and reciprocatingly driven towards and away from the leading end of the plate by a drive unit, as well as a control unit for actuating the plate winding rod, the plurality of leaf springs of the preloaded element, the plate winding-rod rotating unit and the plate press roll at previously determined times.

The published German Patent Document DE 39 36 458 C1 is concerned with a device for positionally-accurate rapid clamping and tensioning of printing plates. The invention relates to a device for positionally-accurate rapid clamping and tensioning of printing plates on a plate cylinder. Arranged in the frame walls are clamping tools which, following appropriate positioning of the plate cylinder, are insertable into coupling sleeves of the eccentric shafts of front and rear clamping rails, respectively, by having pressure medium applied thereto. The clamping and unclamping is then performed by rotating the clamping tools via levers and compressed-air cylinders. For the purpose of tensioning or tautening, a motor, such as a compressed-air motor, is arranged in the cylinder channel.

SUMMARY OF THE INVENTION

It is an object of the invention to provide a remotely actuatable device for tensioning or tautening a flexible cover or dressing, the device being of relatively simple construction, readily accessible from the outside, and able to be operated during the rotation of the cylinder, as well as having a short response time.

With the foregoing and other objects in view, there is provided, in accordance with one aspect of the invention, a device for actuating a tensioning device for fastening flexible packings to printing-unit cylinders of rotary printing machines, the actuating device having a tensioning shaft for accommodating respective ends of flexible packings, for clamping at least one end of the flexible packings, and an actuating mechanism arranged outside the printing-unit cylinder for activating the tensioning shaft, comprising an actuating element passing through a cylinder journal of the printing-unit cylinder and being displaceable coulisse-like relative to the cylinder journal, and a transmission element via which the displacement of the actuating element is convertible into a rotational movement of an attachment to the tensioning shaft.

In accordance with another feature of the invention, the printing-unit cylinder is a printing-form cylinder, and the actuating element is displaceable parallel to the axis of the printing-form cylinder.

In accordance with a further feature of the invention, the printing-unit cylinder is a printing-form cylinder, and the actuating element is mounted coaxially with the axis of the printing-form cylinder.

In accordance with an added feature of the invention, the printing-unit cylinder is a printing-form cylinder, and the actuating element in the printing-form cylinder has a restoring element assigned thereto.

In accordance with an additional feature of the invention, the restoring element is braced against an abutment in the printing-form cylinder and is located opposite one end of the actuating element.

In accordance with yet another feature of the invention, the restoring element is a helical spring.

In accordance with a first alternative feature of the invention, the restoring element is a helical spring packet.

In accordance with a second alternative feature of the invention, the restoring element is formed as at least one disk spring.

In accordance with a third alternative feature of the invention, the restoring element is formed by a compressible medium.

In accordance with yet a further feature of the invention, the actuating element is formed with a recess wherein the transmission element engages.

In accordance with yet an added feature of the invention, the recess is defined by a bottom surface and an end face formed in the actuating element.

In accordance with yet an additional feature of the invention, the bottom surface extends at an angle to the axis of the printing-form cylinder.

In accordance with still another feature of the invention, the bottom surface extends at an angle to the center of the printing-form cylinder.

In accordance with still a further feature of the invention, the bottom surface of the recess is formed as a low-wear surface.

In accordance with still an added feature of the invention, the transmission element is arranged perpendicularly to the direction of displacement of the actuating element.

In accordance with still an additional feature of the invention, the transmission element is movably accommodated in a bore formed in a journal of the cylinder.

In accordance with again another feature of the invention, the transmission element has at least one rounded end face.

In accordance with again a further feature of the invention, the restoring element is active upon the tensioning element attachment during a vertical movement of the transmission element.

In accordance with again an added feature of the invention, the tensioning shaft attachment, the restoring element and the abutment of the restoring element are accommodated at an end face of the printing-unit cylinder.

In accordance with again an additional feature of the invention, the actuating device includes an adjusting unit for effecting a displacement of the actuating element, the adjusting unit being located opposite the end of the actuating member facing away from the restoring element.

In accordance with another aspect of the invention, there is provided a printing-unit cylinder having a device for actuating a tensioning device for fastening flexible covers to printing-unit cylinders of rotary printing machines, including at least one of the foregoing features.

In accordance with a further feature of the invention, the flexible packing is a printing plate.

In accordance with an alternative feature of the invention, the flexible packing is a rubber blanket.

In accordance with an additional aspect of the invention, there is provided a printing unit having a device for actuating a tensioning device for fastening flexible packings to printing-unit cylinders of rotary printing machines, including at least one of the foregoing features thereof.

In accordance with a concomitant aspect of the invention, there is provided a method of operating a tensioning device for fastening flexible packings, comprising the steps of: displacing an actuating member by an adjusting unit counter to the action of a restoring element; moving a transmission element that engages in a recess formed in the actuating element vertically counter to the action of the restoring element; rotating a tensioning shaft, which is accommodated in a cylinder gap, by an attachment secured to the shaft, the attachment having a stop face upon which the transmission element acts.

The advantages associated with the solution according to the invention are of a flexible nature, because the actuating device is quite simply constructed and has only a few moving parts. The actuating rod, which passes partially through the printing-unit cylinder and completely through the cylinder journal, can be operated simply by remote control from outside the printing unit. The parts provided on the printing-unit cylinder, such as the tensioning shaft attachment, the transmission element and the stop for the restoring element, are all accommodated at one end of the printing-unit cylinder, so that all the components are accessible during maintenance work or repair work, without having to remove the printing-unit cylinder, whether it is a plate cylinder or a blanket cylinder, in total from the printing unit.

In a further refinement of the idea upon which the invention is based, the actuating element is arranged to be displaceable parallel to the axis of the printing-plate cylinder. The rod-like actuating element can be mounted in the printing-unit cylinder coaxially with the cylinder axis and, for the purpose of restoring it into the rest position, can be provided with a restoring element, for example, a compression spring provided in a cavity in the printing-unit cylinder. The restoring element, for example, in the form of a compression spring, is supported on an abutment in the printing-unit cylinder and, with its opposite end, rests upon one end of the actuating element. The restoring element may be, on the one hand, spirally wound helical springs, or helical spring packets connected in series or parallel. Disk springs or disk spring packets can also be used to achieve spring characteristics which run degressively or progressively. It is also conceivable to use a compressible medium as a restoring element, but in that case care would have to be taken to seal the relatively movable actuating element in the printing-unit cylinder.

Advantageously provided on the actuating element is a recess, in which one end of a transmission element engages, while the other end of the transmission element, passing through the wall of the cylinder journal, is positioned underneath the tensioning shaft attachment. The recess in the actuating element is defined by a bottom surface and an end face; the bottom surface extends at an angle in the direction of the center of the printing-unit cylinder. One end of the transmission element is in contact with the inclined bottom surface of the recess; the bottom surface is provided with a low-wear surface, for example produced by using a hardening process. The transmission element moves perpendicularly to the axis of rotation of the printing-unit cylinder in a bore formed in the cylinder journal. The ends of the transmission element can be rounded and also hardened. During the vertical movement of the transmission element produced by the displacement of the inclined bottom surface, the clamping element attachment has impressed thereon a rotational movement counter to the restoring force of an energy store.

Printing-unit cylinders to which flexible packings can be fastened, whether they are finite printing plates or rubber blankets, can be equipped with the device according to the invention. The printing-unit cylinders can be arranged in printing units of offset printing machines, there being, in the individual printing units, adjusting or setting units with which the device according to the invention can be actuated.

The invention also includes a method of actuating a tensioning device for fastening flexible packings, including the following method steps:

displacing a fastening member, counter to the action of a restoring element, through the intermediary of an adjusting or setting unit;

moving a transmission element which engages in a recess in the actuating element, vertically counter to a further restoring element assigned to the transmission element;

rotating a tensioning shaft, that is accommodated in a cylinder gap, by an attachment which is fitted to the shaft, the attachment having a stop face upon which the transmission element acts.

Other features which are considered as characteristic for the invention are set forth in the appended claims.

Although the invention is illustrated and described herein as embodied in a remotely controllable clamping and tensioning device on a printing-unit cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
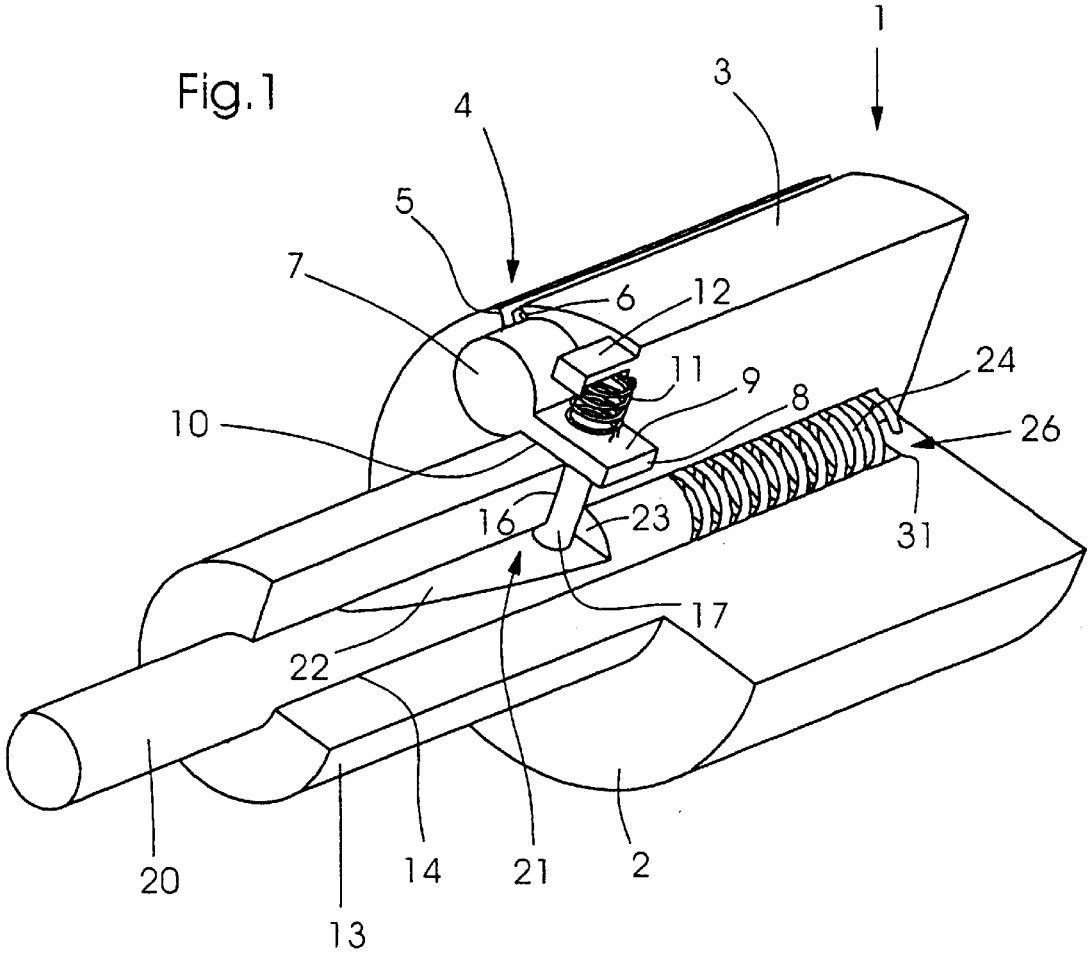
FIG. 1 is a partly broken-away perspective view of a printing-unit cylinder with remotely operatable actuating elements shown in the rest position thereof, and a stress-relieved tensioning shaft at a cylinder or lock-up gap.

Referring now to the drawings and, first, particularly to FIG. 1 thereof, there is shown therein a printing-unit cylinder with a remotely operatable actuating element in rest position and a tension-relieved tensioning shaft at a tensioning channel.

A printing-unit cylinder 1 shown partly cut away is formed with a cylinder or lock-up gap 4, in which the ends of a flexible cover, such as a printing plate or a rubber blanket, can be accommodated. The cylinder gap 4 is bounded by a cylinder-gap leading edge 5 and a cylinder-gap trailing edge 6 and opens into the circumferential surface 3 of the printing-unit cylinder 1. Located on an end face 2 of the printing-unit cylinder 1 is a cylinder journal 13 extending coaxially with the axis of rotation of the printing-unit cylinder 1. Located in the cylinder gap 4 is a tensioning shaft 7 by the use of which one end or both ends of the flexible cover can be clamped or locked. Provided coaxially relative to the axis of rotation of the printing-unit cylinder 1 and of the cylinder journal 13 is a bore 14 wherein a rotationally symmetrical actuating element 20 is located. A loading is applied thereto by a restoring element 24, illustrated herein in the form of a helical spring. The restoring element 24 rests, at one end thereof, against an abutment 31 formed in the printing-unit cylinder 1, and is supported, at the other end thereof, on one end of the actuating element 20, and is therefore completely enclosed in the bore 14 of the printing-unit cylinder 1. In the operating phase illustrated in FIG. 1, the actuating element 20 and the restoring element 24 are in a tension-relieved position 26. Formed in the actuating element 20 is a recess 21 that is bounded by a bottom surface 22 and an end face 23. The bottom surface 22 is formed on the actuating element 20 so that it extends at an angle towards the center of the printing-unit cylinder 1. The end face 23 extends perpendicularly to the axis of the actuating element 20. The bottom surface 22 defining the recess 21 may advantageously be subjected to a hardening process, and is thus less susceptible to wear. A transmission element 17 passing through the wall of the cylinder journal 13 and provided with rounded end faces 18 and 19, respectively, engages at one end thereof in the recess 21 formed on the actuating element 20. The other end of the transmission element 17 projects rectilinearly out of the circumferential surface of the cylinder journal 13 and is positioned underneath an attachment or projection 8 of the tensioning shaft 7. The attachment 8 of the tensioning shaft 7 is, in turn, located laterally on the tensioning shaft 7 and effects the tensioning of one or both ends of flexible packings or coverings, such as flat printing plates or rubber blankets, on the circumferential surface 3 of the printing-unit cylinder 1. The tensioning-shaft attachment 8 is formed as a lever having an upper attachment surface 9 and a lower attachment surface 10, as viewed in FIG. 1. Located above the upper attachment surface 9 of the attachment 8, at the end 2 of the printing-unit cylinder 1, is an abutment 12 for a compression spring 11 that is illustrated in FIG. 1 in a tension-relieved state. The lower attachment surface 10 of the attachment 8 is located at a short distance from the surface of the cylinder journal (note also FIG. 2).

Figure 2:
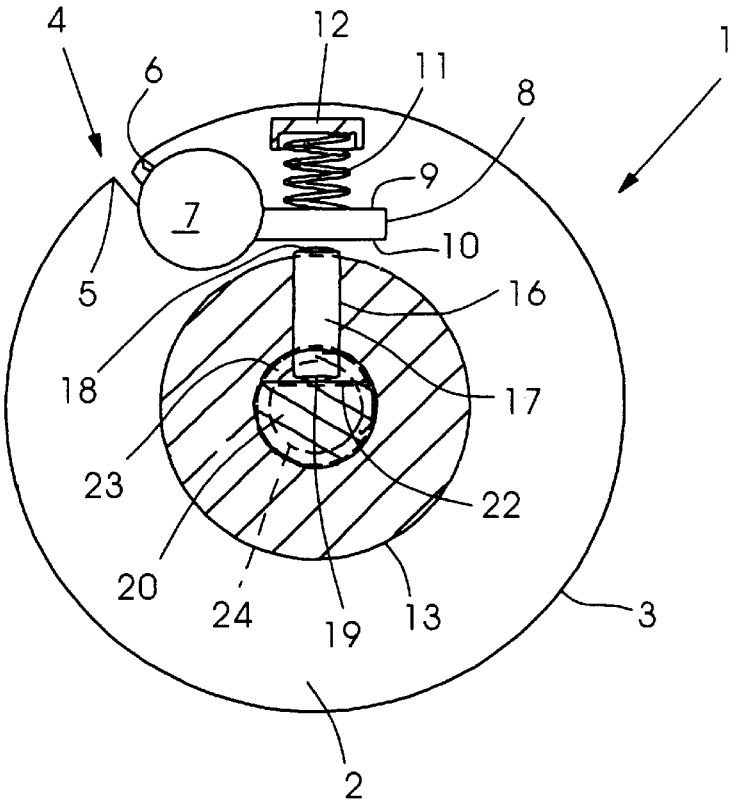
FIG. 2 is a cross-sectional view of FIG. 1 taken through the cylinder journal of the printing-unit cylinder along a plane located in front of an end thereof.

The illustration according to FIG. 2 represents a cross section taken through the cylinder journal of the printing-unit cylinder, the plane of the cross section being forward of the visible end face of the printing-unit cylinder.

The view of FIG. 2 reveals that the attachment 8 formed with the upper and the lower attachment surfaces 9 and 10, respectively, is arranged somewhat offset in relation to the axis of rotation of the tensioning shaft 7. Optimal utilization of the tensioning travel path necessary for clamping the packing or covering can be achieved with the arrangement shown. The abutment 12 at the end face 2 of the printing-unit cylinder 1 surrounds the upper end of the compression spring 11 serving as a restoring member for the tensioning-lever attachment 8. Shown in cross section is the transmission element 17 passing through the wall of the cylinder journal 13 and formed with rounded end faces 18 and 19, respectively. The upper end face 18 passes straight through the wall of the cylinder journal 13, while the other end face 19 rests on the inclined bottom surface 22 of the actuating element 20. The latter is completely enclosed by the printing-unit cylinder 1 and the wall of the cylinder journal 13. The restoring element 24, which is accommodated between the actuating element 20 and an abutment 31 on the printing-unit cylinder 1, is illustrated in broken lines.

Figure 3:
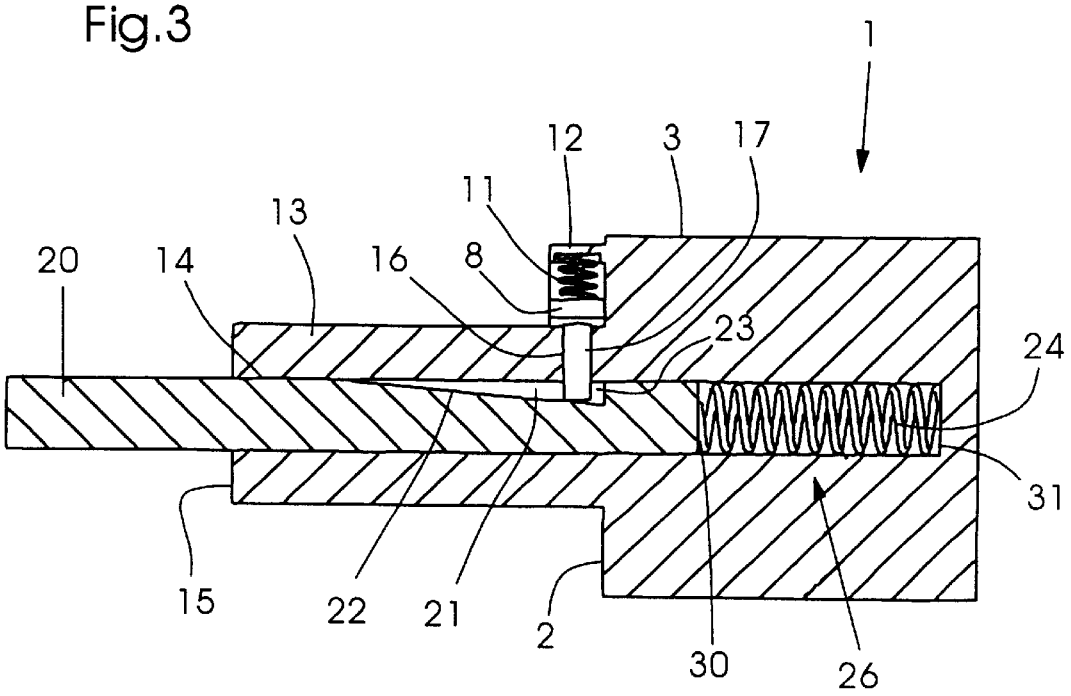
FIG. 3 is a longitudinal sectional view of the cylinder journal and part of the printing-unit cylinder shown in FIG. 2, the device according to the invention being in a non-tensioned state.

The cylinder gap 4 extending into the interior of the printing-unit cylinder 1 and also accommodating the tensioning shaft 7 is illustrated in FIG. 3 bounded by the leading and trailing edges 5 and 6, respectively, thereof. The leading edge of a printing plate, for example, can be hooked into the leading edge 5, while the trailing end of the printing plate can be clamped by the tensioning shaft 7 at the rear edge 6. It is equally possible for two tensioning shafts 7 to be accommodated in the printing-unit cylinder 1, in order, for example, to clamp the leading and trailing edge of a finite rubber blanket. The flexible packing or covering may be printing plates, transfer-cylinder packings or coverings and, for example, rubber blankets, underlay sheets or the like.

FIG. 3 is a longitudinal sectional view taken through the cylinder journal and part of the printing-unit cylinder, the actuating device according to the invention being in the non-tensioned state.

If the actuating element 20 is in the position illustrated in FIG. 3, namely in the non-tensioned phase, the transmission element 17 projects into a very deep section of the recess 21.

The upper end face 18 of the transmission element 17 is thus located only slightly above the outer surface of the cylinder journal 13. Both the restoring element 24 assigned to the actuating element 20, and the compression spring 11, are in the non-tensioned state in FIG. 3. The actuating element 20 is shifted by the restoring element 24 into the phase illustrated in FIG. 3, wherein the restoring element 24 is then completely tension-relieved. The recess 21 is completely enclosed by the inner walls of the cylinder journal 13 and produces an adjusting travel for the transmission element 17, the travel path being dimensioned precisely by the inclination and length of the bottom surface 22 defining the recess 21, the transmission element 17 being moved by the travel out of the wall of the cylinder journal 13. Due to the movement of the transmission element 17 out of the wall of the cylinder journal 13, the displacement of the actuating element 20 is converted into a rotational movement of the attachment 8 about the axis of rotation of the tensioning shaft 7.

Figure 4:
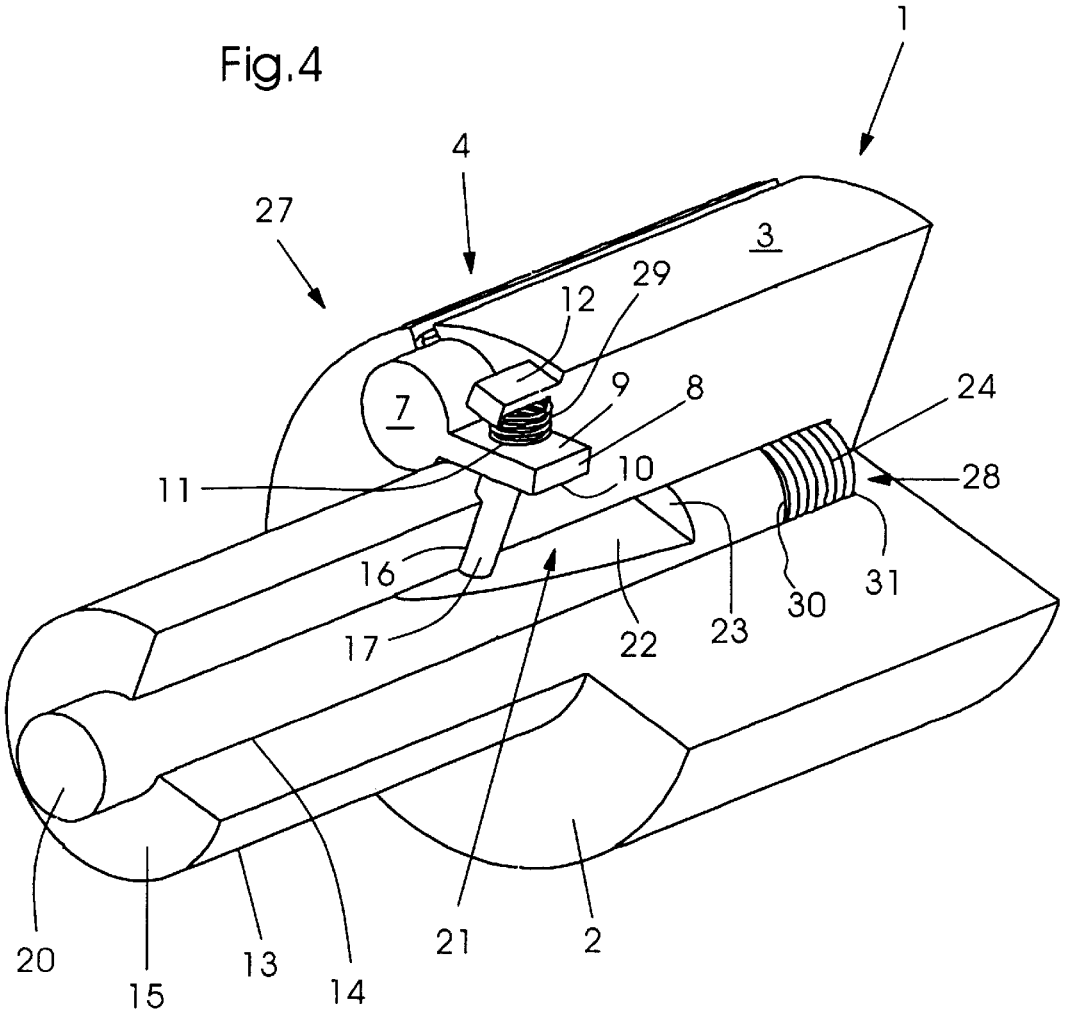
FIG. 4 is a slightly enlarged view of FIG. 1 showing the printing-unit cylinder with a remotely operatable actuating element in a tensioned state wherein the tensioning shaft is loaded.

FIG. 4 shows the device according to the invention in a printing-unit cylinder 1, the inventive device being in the tensioned phase.

Figure 5:
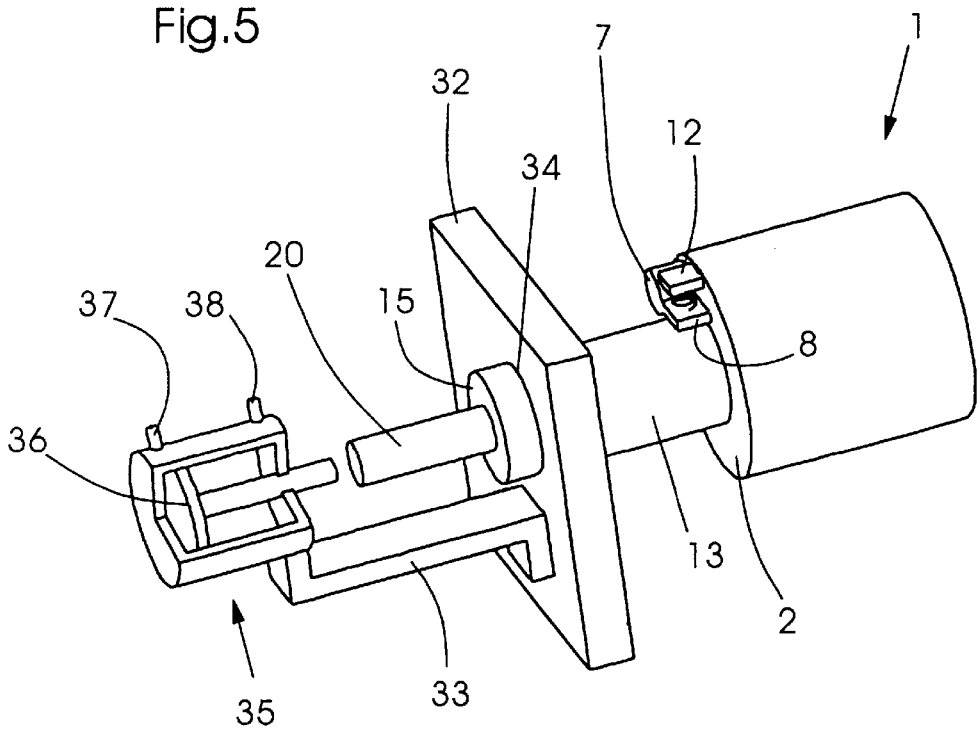
FIG. 5 is a perspective view of an adjusting unit disposed outside a side wall and acting upon one end of an actuating element like that of FIG. 4.

By an adjusting or setting unit illustrated in greater detail in FIG. 5, the actuating element 20 is slid, counter to the action of the restoring element 24, into the bore 14 through the cylinder journal 13 and partially into the printing-plate cylinder 1. In the exemplary embodiment, the displacement movement is limited by the block length of the helical spring, identified by reference numeral 28. Instead of the illustrated helical spring 24, sets or packets of springs connected in series or parallel, disk spring packets or a sealed-off air volume can also be used as the restoring element. If the actuating element 20 moves into the printing-unit cylinder 1, the illustrated course of the bottom surface 22 impresses an outward movement onto the transmission element 17, so that the tensioning shaft attachment 8 is rotated in a counterclockwise direction, as illustrated in FIG. 4. Accordingly, the restoring element 11 between the abutment 12 at the end face 2 and the upper attachment surface 9 of the attachment 8 is compressed, due to which one end, for example, of a printing form or plate, is clamped on the circumferential surface 3 of the printing-plate cylinder 1.

In FIG. 4, the device according to the invention is shown in the tensioned position. As long as the restoring element 24 has not yet been compressed to the block length 28, the flexible packing or covering can be retensioned during the rotation of the printing-unit cylinder 1. Retensioning may become necessary in the case of rubber blankets, such as are used, for example, in sheet-fed offset rotary printing machines. Although the figures illustrate a printing-unit cylinder 1, to the circumference 3 of which a printing plate can be clamped, the invention can also be utilized for a cylinder to the circumference of which a finite packing or covering, such as a rubber blanket, is clamped. If the tensioning shaft 7 is to be retensioned during operation, the actuating element 20 is simply pressed farther into the interior of the bore 14 by the adjusting unit, assuming that the restoring element 24 is suitably dimensioned, so that the transmission element 17 can be pushed out of the cylinder journal 13 by a yet remaining section of the bottom surface 22, resulting in the retensioning of the tensioning shaft 7.

An adjusting or setting unit 35 is reproduced, by way of an example, in FIG. 5. This adjusting unit 35, shown here as a piston/cylinder unit to which compressed air is applied, is mounted by a flange 33 on the side wall 32 of a printing unit. A piston rod of a piston 36 is disposed opposite one end of the actuating element 20 which passes through the cylinder journal 13. The cylinder journal 13 is mounted in a bearing bore 34 formed in the side wall 32, and the piston rod of the piston 36 makes contact with the actuating element 20 at the end face thereof. The restoring element 24 accommodated in the interior of the printing-unit cylinder 1 is, however, not shown in FIG. 5.

The tensioning shaft 7 and the attachment 8 together with the abutment 12 are indicated diagrammatically at the end 2 of the printing-unit cylinder 1, and are freely accessible from the outside after a cylinder guard has been opened. It should be noted that, besides an adjusting unit 35 that is acted upon pneumatically, an electromotively acting adjusting or setting unit, an hydraulic adjusting or setting element or the like can also be used.

Figure 6:
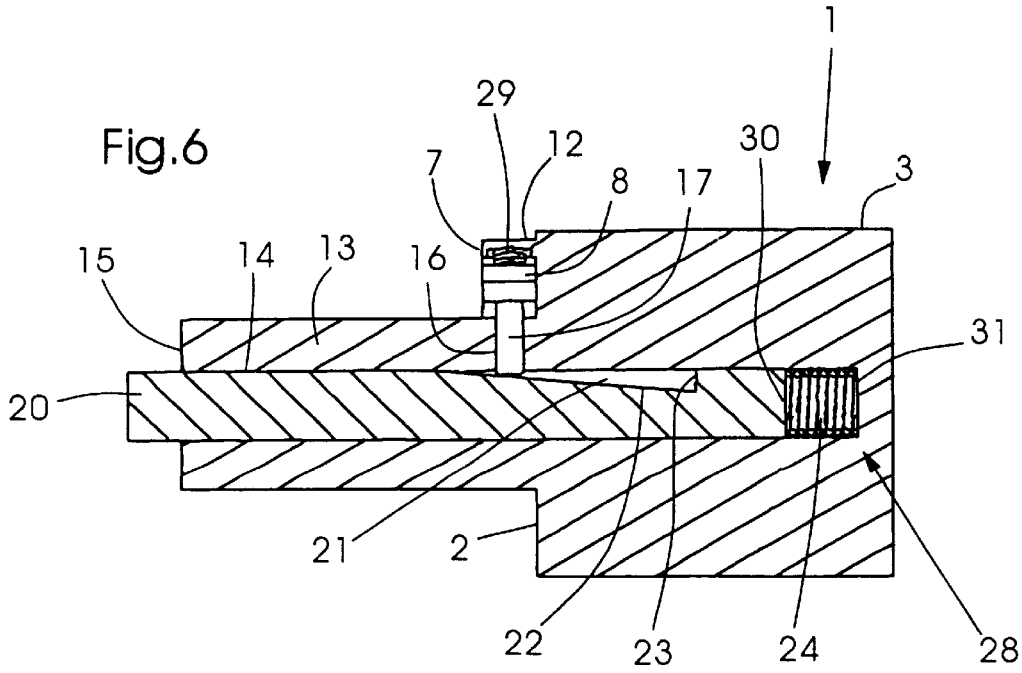
FIG. 6 is a reduced longitudinal sectional view of FIG. 1 showing the cylinder journal and part of the printing-unit cylinder, with the device according to the invention being in a tensioned state.

FIG. 6 is a longitudinal sectional view through the cylinder journal and part of the printing-unit cylinder, the device according to the invention being in the tensioned phase. Through the intermediary of an adjusting or setting unit 35, as shown in FIG. 5, the actuating element 20 has been pushed into the cylinder 1. The restoring element 24 has been compressed to the block length 28 and is braced against the abutment 31 of the printing-unit cylinder 1. The bore 14 that passes through the cylinder journal 13 completely surrounds the recess 21, which is bounded by the illustrated bottom surface 22 and the vertical end face 23. Because the inclined plane 22 now presses the transmission element 17 upwardly out of the bore 16 passing through the wall of the cylinder journal 13, the tensioning shaft attachment 8 is rotated in the counterclockwise direction, and the restoring element 11 (note FIG. 1) assumes the tensioned position 29 thereof. If the actuating element 20 is tension-relieved by the adjusting or setting unit 35, the spring 24 is relieved of tension, and the actuating element 20 again moves out of the bore 14 that passes partly through the cylinder journal 13 and the cylinder 1.

The materials from which the bottom face 22 of the recess 21 and the severely stressed ends of the transmission element 17 are composed are preferably those having high degrees of hardness. Those materials can either be machined into the actuating element 20 or can be coated on the ends of the severely stressed transmission element 17.

I claim:

1. A device for actuating a tensioning shaft that is used for clamping an end of a flexible cover to a printing-unit cylinder of a rotary printing machine, the device comprising:

an actuating element passing through a cylinder journal of the printing-unit cylinder and being axially displaceable relative to the cylinder journal, said actuating element formed with a recess therein; and a transmission element via which the displacement of said actuating element is convertible into a rotational movement of an attachment of the tensioning shaft, said transmission element engaging said recess of said actuating element.

2. The actuating device according to claim 1, wherein said actuating element is displaceable parallel to the axis of the printing-unit cylinder.

3. The actuating device according to claim 1, wherein said actuating element is mounted coaxially with the axis of the printing-unit cylinder.

4. The actuating device according to claim 1, wherein said actuating element has a restoring element assigned thereto.

5. The actuating device according to claim 4, wherein said restoring element is braced against an abutment in said printing-form cylinder and is located opposite one end of said actuating element.

6. The actuating device according to claim 4, wherein said restoring element is a helical spring.

7. The actuating device according to claim 4, wherein said restoring element is a spring.

8. The actuating device according to claim 1, further comprising a restoring element that is active upon the attachment of the tensioning shaft during a vertical movement of said transmission element.

9. The actuating device according to claim 8, wherein said restoring element is accommodated at an end face of the printing-unit cylinder.

10. The actuating device according to claim 1, wherein said actuating element has a first end and a second end opposite said first end, and comprising:

a restoring element acting on said first end of said actuating element; and an adjusting unit for effecting a displacement of said actuating element, said adjusting unit adjacent said second end of said actuating element.

11. The actuating device according to claim 1, wherein said recess is defined by a bottom surface and an end face formed in said actuating element.

12. The actuating device according to claim 11, wherein said bottom surface extends at an angle to the axis of the printing-unit cylinder.

13. The actuating device according to claim 11, wherein said bottom surface extends at an angle to the center of the printing-unit cylinder.

14. The actuating device according to claim 11, wherein said bottom surface of said recess is formed as a low-wear surface.

15. The actuating device according to claim 1, wherein said transmission element is arranged perpendicularly to the direction of displacement of said actuating element.

16. The actuating device according to claim 15, wherein said transmission element is movably accommodated in a bore formed in the journal of the cylinder.

17. The actuating device according to claim 1, wherein said transmission element has at least one rounded end face.

18. A printing-unit cylinder having the device for actuating a tensioning shaft according to claim 1.

19. The printing-unit cylinder according to claim 18, wherein the flexible cover is a printing plate.

20. The printing-unit cylinder according to claim 18, wherein the flexible cover is a rubber blanket.

21. A printing unit having the device for actuating a tensioning shaft according to claim 1.

22. A method of operating a tensioning device for fastening flexible packings, comprising the steps of: displacing an actuating member by an adjusting unit counter to the action of a restoring element; moving a transmission element that engages in a recess formed in the actuating element vertically counter to the action of the restoring element; rotating a tensioning shaft, which is accommodated in a cylinder gap, by an attachment secured to the shaft, the attachment having a stop face upon which the transmission element acts.

* * * * *